US005875564A

United States Patent [19]

Kirkbir et al.

[11] Patent Number: 5,875,564

[45] Date of Patent: Mar. 2, 1999

[54] METHOD AND APPARATUS FOR DRYING WET POROUS BODIES UNDER SUBCRITICAL TEMPERATURES AND PRESSURES

[75] Inventors: Fikret Kirkbir, Los Angeles; Satyabrata Raychaudhuri, Agoura; Douglas Meyers, Calabasas; Hideaki Murata, Agoura, all of Calif.

[73] Assignee: Yazaki Corporation, Tokyo, Japan

[21] Appl. No.: 914,433

[22] Filed: Aug. 19, 1997

[51] Int. Cl.[6] ..... F26B 5/06

[52] U.S. Cl. ..... 34/305; 34/331; 34/343

[58] Field of Search ..... 34/78, 79, 169, 34/182, 212, 219, 305, 331, 343, 363, 470; 65/17.1, 17.2; 501/11, 12, 27; 423/335, 338

[56] References Cited

U.S. PATENT DOCUMENTS

| | | | |
|---|---|---|---|
| 5,023,208 | 6/1991 | Pope et al. | 501/12 |
| 5,243,769 | 9/1993 | Wang et al. | 34/27 |
| 5,343,633 | 9/1994 | Wang et al. | 34/92 |
| 5,473,826 | 12/1995 | Kirkbir et al. | 34/405 |

*Primary Examiner*—Henry A. Bennett
*Assistant Examiner*—Steve Gravini
*Attorney, Agent, or Firm*—Sheppard, Mullin, Richter & Hampton; James R. Brueggemann

[57] ABSTRACT

An improved apparatus, and related method of operation, is described for rapidly drying large monoliths of glass, ceramic and/or composite material, under subcritical conditions, while minimizing the risk of cracking the monolith during the drying process. The apparatus incorporates a pressure chamber for carrying the monolith to be dried, with no significant limitation on the size of the monolith relative to the size of the chamber. The monolith is initially immersed in a suitable drying solvent, and the temperature of the pressure chamber is raised to a predetermined value below the solvent's critical temperature, which raises the pressure to a predetermined value, likewise below the solvent's critical pressure. At a selected time during the drying process the pressure chamber is connected to a diffusion chamber, to draw away and condense solvent vapor. This drawing away of solvent vapor continues until the monolith is dry, at which time the pressure chamber is purged with an inert gas and then depressurized in a controlled manner. The apparatus thereby is configured to dry the monolith at an even lower subcritical pressure than previous apparatus of this kind, leading to increased safety and reduced operating expenses.

18 Claims, 1 Drawing Sheet

METHOD AND APPARATUS FOR DRYING WET POROUS BODIES UNDER SUBCRITICAL TEMPERATURES AND PRESSURES

BACKGROUND OF THE INVENTION

This invention relates generally to sol-gel processes for producing dry gel bodies and, more particularly, to drying processes and apparatus for rapidly drying wet porous monolithic bodies at elevated, subcritical temperatures and pressures.

Sol-gel processes are gaining increased popularity in the creation of large, high-purity monoliths of glass and ceramic materials. In such processes, a desired solution, i.e., a sol, including glass- or ceramic-forming compounds, solvents, and catalysts, is poured into a mold and allowed to react. Following hydrolysis and condensation reactions, the sol forms a porous matrix of solids, i.e., a gel. With additional time, the gel shrinks in size and expels fluids from its pores. The wet gel is then dried in a controlled environment, to remove fluid from its pores, and it is then consolidated into a dense monolith.

Advantages of the sol-gel process include chemical purity and homogeneity, flexibility in the selection of compositions, processing at relatively low temperatures, and producing monolithic articles close to their final desired shapes, thereby minimizing finishing costs. Despite these advantages, the sol-gel process has generally been difficult to use in producing monoliths that are large and free of cracks. These cracks arise during the drying step of the process, and they are believed to result from stresses due to capillary forces in the gel pores. Efforts to eliminate the cracking problem present in sol-gel monoliths have been diverse. However, the problem of cracking has not previously been eliminated without adversely affecting one or more of the advantages, as listed above, or without incurring undue expense.

Sol-gel derived bodies have previously been dried using any of several distinctly different approaches. In one approach, the wet gel is heated above the critical temperature of the solvent being used as the drying medium, in an autoclave or drying chamber that permits the pressure to exceed the solvent's critical pressure. Above the critical temperature and pressure, there is no vapor/liquid interface in the pores, so no capillary force exists. Therefore, the shrinkage of the wet gel is negligible during drying. The solvent is removed from the pores while the critical temperature and pressure are exceeded, until the gel is completely dried. Although this "supercritical" drying technique is generally effective, providing an autoclave operable at the required temperatures and pressures (greater than 243° C. and 928 psia in the case of ethyl alcohol) can be prohibitively expensive for large scale manufacturing. Operating at such high temperatures and pressures also can be dangerous.

Inorganic solvents, such as liquid carbon dioxide ($CO_2$), also have been used as the drying solvent in an attempt to at least avoid the need to operate at excessively high temperatures. $CO_2$'s critical temperature is 31° C., and its critical pressure is 1070 psia. $CO_2$ also is advantageously used because it is not explosive. However, the compression equipment necessary for liquefying gaseous $CO_2$, and the cryogenic equipment necessary for maintaining $CO_2$ in its liquid state, are very expensive. Consequently, $CO_2$ is not believed to provide a commercially attractive alternative.

In an alternative approach, the wet gels are dried at ambient pressure (14.7 psia), and at temperatures close to or slightly higher than the boiling point of the solvent used as the drying medium. An example of this approach is provided in U.S. Pat. No. 5,243,769, to Wang et al. This approach, however, causes excessive shrinkage of the wet gel during drying, resulting in very small pore size dry gels.

In another approach, the gel is heated to such temperatures in a chamber having several pin holes through which the evaporating liquid escapes. Because the chamber is ventilated to the ambient environment, the pressure cannot increase above ambient pressure. Although this approach is generally effective, it can be very slow, at times requiring as much as a month or more to complete the drying process. The drying rate can be increased by increasing the area of the pin holes, but this can lead to cracking. Moreover, this drying process also results in considerable shrinkage of the wet gel.

In variations of this ambient pressure drying technique, colloidal silica particles have been added to the sol to increase the average pore size and to increase the strength of the solid matrix. Although this technique is generally effective, the presence of colloidal silica particles sacrifices the gel's otherwise inherent homogeneity, and thus restricts the range of compositions that can be utilized. In addition, devitrification spots can be created if mixing of the colloidal silica particles is imperfect.

Alternatively, drying control additives, such as dimethyl formamide, can be added to the sol, to enlarge the pores and to control the drying rate. These additives are then removed during the drying step. Although this alternative technique is generally effective in eliminating cracking, the resulting monoliths can sometimes have a large number of bubbles.

Another approach for eliminating cracking of the glass or ceramic gel during the drying step has been to hydrothermally age the gel while it is still wet. This increases the average pore size in the gel, and correspondingly decreases the capillary stresses encountered during drying. Although this technique is generally effective, the aging step increases the time and the equipment costs for drying gels.

Yet another approach for eliminating cracking of the gel during the final drying step is to dry the gel at an elevated temperature and pressure below the solvent's critical temperature and pressure. This subcritical drying process is carried out in a specially configured, sealed pressure chamber. The chamber is controllably heated, to evaporate the solvent and thereby cause the pressure within the chamber to rise until it eventually stabilizes at a substantially constant value. The value of this final pressure is determined according to the total amount of solvent, including both free solvent and solvent in the pores of the wet gel, present in the chamber before the chamber is sealed and heated. The chamber is sized so that it can accommodate all of this solvent in its gaseous form without reaching the solvent's critical pressure. This drying process is described in greater detail in U.S. Pat. No. 5,473,826, to Kirkbir et al. Although this subcritical drying process is effective in reliably and inexpensively drying wet gel monoliths, the limitation on the total amount of initial liquid solvent relative to the size of the drying chamber is considered to unduly limit the sizes of the gels that can be dried.

It should, therefore, be appreciated that there is a need for an improved drying process and apparatus such that the drying process can be carried out below the critical temperature and pressure of the drying solvent and that yields crack-free, porous glass and ceramic monolithic bodies with negligible shrinkage of the gel in even larger sizes than was previously attainable. The present invention fulfills these needs.

SUMMARY OF THE INVENTION

The present invention is embodied in an apparatus, and related method of operation, for rapidly drying a porous monolith such as a glass or ceramic gel of a kind having a matrix that carries a liquid in its pores, at temperatures and pressures below the critical temperature and pressure of a drying solvent that is used. The drying apparatus is configured to function effectively to dry the monolith with minimal risk of cracking, and it is relatively safe and inexpensive to operate.

More particularly, the apparatus of the invention includes a pressure container that defines a pressure chamber sized to receive the monolith, immersed in a predetermined drying solvent, and a diffusion container that defines a diffusion chamber sized to receive drying solvent diffused from the pressure chamber. The pressure chamber and the diffusion chamber are connectable to each other by a conduit, and a heater heats the pressure chamber to a prescribed temperature below the solvent's critical temperature, such that the solvent is vaporized and diffused via the conduit to the diffusion chamber. Condensation preferably is effected using a condenser connected to the diffusion chamber.

In operation, the monolith is immersed in the drying solvent and placed within the pressure chamber. The pressure chamber then is heated using the heater, to vaporize the solvent in a predetermined manner, such vaporization elevating the pressure within the chamber to a pressure still below the solvent's critical pressure. The diffusion chamber then is pressurized with an inert gas to a pressure that is the same as that in the pressure chamber, and a valve that is part of the conduit connecting the pressure chamber with the diffusion chamber is opened, to allow solvent vapor to be drawn from the pressure chamber to the diffusion chamber, where it is condensed. In an alternative embodiment, the conduit connecting the two chambers remains open continuously throughout the process. In another alternative embodiment, the pressure of the diffusion chamber is kept constant by continuous flow of an inert gas while the solvent continues to be vaporized in the pressure chamber and drawn to the diffusion chamber for condensation. Eventually, in all of the embodiments, the solvent in the pressure chamber will have been entirely vaporized, and the monolith will be dry.

In a more detailed feature of the invention, the apparatus can further include means, operable after the monolith is dry, for depressurizing the pressure chamber to ambient pressure, at a prescribed rate. In addition, the apparatus can further include means for purging the pressure chamber with an inert gas after the monolith is dry, such means directing the inert gas through the pressure chamber and to the condenser, to condense additional solvent vapor.

Other features and advantages of the present invention will become apparent from the following description of the preferred embodiment, taken in conjunction with the accompanying drawing, which disclose by way of example the principles of the invention.

BRIEF DESCRIPTION OF THE DRAWING

The FIGURE is a schematic drawing of a drying apparatus in accordance with the invention, for use in drying a glass, ceramic or composite gel monolith at subcritical temperatures and pressures.

DESCRIPTION OF THE PREFERRED EMBODIMENT AND PROCESS

Figure 1:
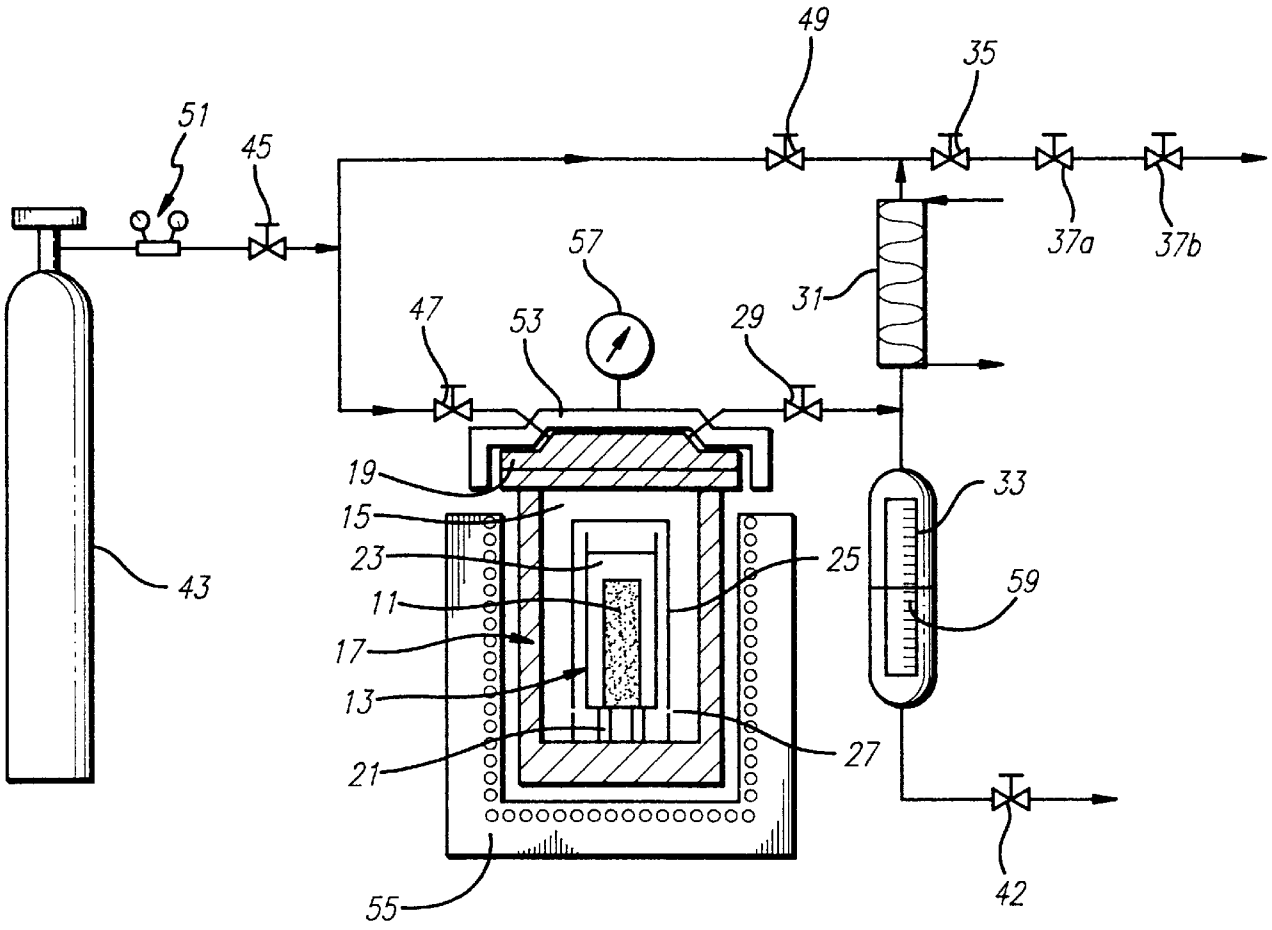

With reference now to the exemplary drawing, there is shown a drying apparatus for rapidly drying a wet, porous, sol-gel derived glass, ceramic or composite monolith, i.e., a gel 11. The drying procedure is carried out at a temperature and pressure below the critical temperature and pressure of the drying solvent, such that it can be done relatively safely and relatively inexpensively. In particular, the wet gel is initially carried in a suitable cup-shaped glass container 13 within a pressure chamber 15, which is defined by a generally cylindrical pressure container 17 and a mating, generally circular cover or head 19. Although the wet gel is depicted to have a generally cylindrical shape, the drying apparatus does not impose any restrictions on the gel's shape or composition.

The cup-shaped glass container 13 that carries the wet gel 11 is elevated within the pressure chamber 15 on one or more glass or metal rings 21, and the gel is initially immersed in a liquid drying solvent 23, preferably having the same composition as the liquid in the gel's pores. Suitable solvents include ethyl alcohol (i.e., ethanol), isopropanol, iso-butanol, 2-pentanol, 2,2,4-trimethylpentane, water, and mixtures thereof. The glass container 13 is then covered by a suitable glass cover 25, which can have an inverted cup shape. The container and cover both alternatively could be formed of a suitable metal. The cover includes holes 27 adjacent to its end, to vent solvent vapors that are produced during the drying process. The use of this glass container and cover ensures that the gel is exposed to a substantially uniform distribution of solvent vapor throughout the drying procedure. The rings 21 ensure that the container receives heat from its exterior substantially uniformly.

The pressure chamber 15 is connected via a ball valve 29 to a condenser 31 and a diffusion chamber 33, which receive and condense solvent vapor delivered from the pressure chamber during the drying process, as will be described below. The condenser, in turn, can be isolated by a stop valve 35, and first and second metering valves 37*a* and 37*b*. The condenser receives chilled water from a chiller (not shown). Condensed solvent that accumulates in the diffusion chamber can be recovered via a stop valve 42 at its lower end.

The drying apparatus further includes a gas cylinder 43 containing a pressurized inert gas (e.g., nitrogen), which is selectively delivered to the pressure chamber 15 via stop valves 45 and 47 and/or to the condenser via the stop valve 45 and a further stop valve 49. A pressure regulator 51 regulates the pressure of the inert gas delivered from the cylinder.

After the pressure head 19 has been secured to the pressure container 17, to seal the pressure chamber 15, and after suitable insulation 53 has been applied over the pressure head, the chamber is heated in a controlled manner by a heater 55. The ball valve 29 and all of the stop valves 35, 42, 45, 47 and 49 are closed at this time. The resulting evaporation of the drying solvent causes the pressure within the pressure chamber to rise, and this is monitored by a pressure gauge 57. This controlled heating continues until the pressure within the chamber reaches any preselected value below the solvent's critical temperature.

After this preselected temperature has been reached, the stop valves 45 and 49 are opened, to pressurize the condenser 31 and the diffusion chamber 33 with inert gas from the gas cylinder 43. Although nitrogen is the preferred gas for this stage of the drying process, any inert gas can be used. The pressure regulator 51 regulates the pressure of the gas being delivered until the diffusion chamber has been pressurized to a value substantially the same as that of the pressure chamber 15. The temperature of the diffusion chamber is maintained at room temperature (about 25° C.) throughout the drying process.

After the pressure in the diffusion chamber 33 has reached the pressure of the pressure chamber 15, the stop valves 45 and 49 are again closed, and the ball valve 29 that separates the two chambers is opened. This allows hot vapors to diffuse from the pressure chamber to the condenser 31, which is continuously maintained by the chilled water at a temperature below the drying solvent's boiling point (at atmospheric pressure). This condenses the vapors, and the resulting condensate is collected in the diffusion chamber.

To accelerate the diffusion of hot vapors to the condenser 31, the temperature of the pressure chamber 15 may be increased further. However, the final temperature is always maintained below the solvent's critical temperature.

This vapor transfer and condensation continues until the solvent has entirely evaporated from within the pressure chamber 15. This condition is evidenced by a stoppage of liquid condensation inside the diffusion chamber 33, as observed through a sight glass 59.

The final pressure of the pressure chamber 15 can be maintained at any selected level between atmospheric pressure and the critical pressure of the drying solvent. This is achieved by maintaining the temperature of the chamber at a constant level below the critical temperature of the solvent, by prepressurizing the diffusion chamber 33 to have the same pressure as the drying chamber, and by then opening the ball valve 29.

After the preselected final temperature has been reached, and the pressure in the chamber 15 has reached a constant value and the condensation in the diffusion chamber 33 has stopped, signifying that the gel 11 is dry, the pressure chamber 15 is depressurized to ambient pressure (14.7 psia) by opening the stop valve 35 and the metering valves 37*a* and 37*b*. The metering valves enable this depressurization to be achieved slowly and in a controlled manner, so that cracking of the dry gel is avoided. The temperature of the pressure chamber preferably is maintained substantially constant during this depressurization step. This temperature is always below the solvent's critical temperature, and it preferably is the same as the final temperature at which the depressurization is initiated.

After the pressure within the pressure chamber 15 has reached ambient pressure, the stop valves 45 and 47 are opened, to purge the pressure chamber with inert gas from the gas cylinder 43. This removes any residual solvent vapors. As mentioned above, nitrogen is the preferred gas, but any inert gas can be used.

Although both the inlet and the outlet for the purging gas are depicted as being located at the top of the pressure chamber, the inlet could alternatively be located at the bottom of the chamber.

During this purging step, the residual solvent vapors are directed through the condenser 31, stop valve 35 and metering valves 37*a* and 37*b* to the atmosphere. Additional condensate thereby is produced, for collection in the diffusion chamber 33.

At this time, the heater 55 is switched off, and the insulation 53 is removed from above the pressure head 19. After the pressure chamber 15 and the dry monolithic gel 11 have cooled to ambient temperature, the chamber is opened and the gel is removed. The dry gel exhibits negligible shrinkage. The condensed solvent in the diffusion chamber 33 can then be recovered by opening the stop valve 42 at its lower end.

The drying apparatus shown in the FIGURE also can be used in a variation of the process described above. In this alternative process, the transfer of solvent vapor from the pressure chamber 15 to the diffusion chamber 33 is accomplished while inert gas continuously flows from the gas cylinder 43. In particular, the stop valves 45, 49 and 35 are opened and the inert gas flows at a suitable rate. This flow rate is controlled by the metering valves 37*a* and 37*b*.

This flow of inert gas maintains a constant pressure within the pressure chamber 15 and the diffusion chamber 33, until the preselected final temperature has been reached. This constant pressure can be maintained at a value substantially lower than it otherwise would have been without the flow of inert gas, making the process less expensive to implement. Although this lower pressure could increase the gel's rate of drying, and although it is a way to accelerate the drying process, care must be taken to avoid drying the gel too fast, which could lead to cracking. One way to counter this increased drying rate would be to reduce the pressure chamber's temperature as compared to what it otherwise would have been. This constant pressure is below the drying solvent's critical pressure.

During the drying process, the temperature of the pressure chamber 15 preferably is increased to accelerate the drying rate. The final temperature of the pressure chamber is above the temperature at which the ball valve 29 was opened and below the solvent's critical temperature. After the final temperature has been reached, and the condensation in the diffusion chamber 33 has stopped, the stop valves 45 and 49 are again closed, and the remainder of the drying process is same as the first mode of operation.

The drying apparatus and process of the invention will be better understood by reference to the illustrative examples set forth below. In each example, the reference numerals correspond to components of the drying apparatus of the FIGURE.

EXAMPLE 1

A wet porous $SiO_2$ gel was prepared by mixing TEOS, ethanol, deionized water, and catalysts like HCl, HF or $NH_3$. After aging and solvent exchanging the pore liquid with ethanol, the wet gel was immersed in fresh ethanol in the glass container 13. The glass container 13 was then placed inside the pressure chamber 15 and covered by the glass cover 25. The pressure chamber was provided by a Model No. N4666 autoclave, manufactured by Parr Instrument Company.

The pressure chamber 15 was sealed airtight, to isolate it from the external environment and the ball valve 29 and all of the stop valves 35, 42, 45, 47 and 49 were closed. The temperature of the pressure chamber was then increased by the heater 55 from room temperature (25° C.) to 172° C. This automatically increased the chamber's pressure to 223.7 psia. At this time, the condenser 31 and the diffusion chamber 33 were pressurized by gaseous nitrogen from the gas cylinder 43, by opening the stop valves 45 and 49 and using the pressure regulator 51. When the pressure within the diffusion chamber reached 223.7 psia, the stop valves 45 and 49 were again closed, and the ball valve 29 was opened. Solvent vapor thereupon began to be transferred from the pressure chamber to the diffusion chamber.

The vapor transfer and condensation continued until the liquid ethanol had entirely evaporated from within the pressure chamber 15. This was evidenced by a stoppage of liquid ethanol condensation inside the diffusion chamber 33, as observed through the side glass 59. The critical temperature and pressure for the pore liquid, ethanol, are 243° C. and 928 psia, respectively, so the process of this Example was carried out under subcritical conditions.

The pressure chamber 15 then was depressurized to ambient pressure (14.7 psia), using the stop valve 35 and the metering valves 37*a* and 37*b*. During this time, the temperature of the pressure chamber was maintained at 172° C. After the chamber was purged with gaseous nitrogen from the gas cylinder 43, by opening the stop valves 45 and 47 and closing the valve 49, the chamber was cooled to room temperature. The chamber was then unsealed and a dry, crack-free monolithic gel 11 was removed. The linear shrinkage of the dry gel during the drying operation was determined to be negligible, i.e., less than 1%.

EXAMPLE 2

A gel 11 was prepared and aged in exactly the same manner as in Example 1, above, except that the pore liquid in the gel was exchanged with iso-propanol, rather than ethanol, and the gel submerged in fresh iso-propanol in the glass cylinder 13 and then transferred to the same pressure chamber 15 as was used in Example 1.

Thereafter, the process described in Example 1 was followed exactly in the same manner, except that the temperature of the pressure chamber 15 was raised by the heater 55 from room temperature (25° C.) to 168° C. This caused the chamber's pressure to increase to 189.7 psia. When these pressure and temperature values were reached, the stop valves 45 and 49 were opened, to pressurize the condenser and the diffusion chamber 33 to the same 189.7 psia value. The stop valves 45 and 47 then were again closed and the ball valve 29 was opened, to allow solvent vapor to be transferred from the pressure chamber to the diffusion chamber.

The vapor transfer and condensation continued until the liquid iso-propanol had entirely evaporated from within the pressure chamber 15. This was evidenced by a stoppage of liquid iso-propanol condensation inside the diffusion chamber 33, as observed through the side glass 59. Because the critical temperature and pressure of iso-propanol are 235.16° C. and 691.2 psia, respectively, the drying process of this Example was conducted under subcritical conditions of the pore liquid.

Thereafter, the process described in Example 1 was followed exactly in the same manner, and a dry crack-free monolithic gel 11 was obtained. The linear shrinkage of the gel during the drying operation was determined to be negligible, i.e., less than 1%.

This Example shows that results comparable to those of earlier Example 1 can be achieved using the drying solvent iso-propanol instead of ethanol.

EXAMPLE 3

A gel 11 was prepared and aged in exactly the same manner as in Example 1, above, except that the pore liquid in the gel was exchanged with iso-butanol, rather than ethanol, and the gel was submerged in fresh iso-butanol in the glass cylinder 13 and then transferred to the same pressure chamber 15 as was used in Example 1.

Thereafter, the process described in Example 1 was followed in exactly the same manner, except that the temperature of the pressure chamber 15 was raised by the heater 55 from room temperature (25° C.) to 139° C. This caused the chamber's pressure to increase to 69.7 psia. When these pressure and temperature values were reached, the stop valves 45 and 49 were opened, to pressurize the condenser and the diffusion chamber 33 to the same 69.7 psia value. The stop valves 45 and 47 then were again closed and the ball valve 29 was opened, to allow solvent vapor to be transferred from the pressure chamber to the diffusion chamber.

The vapor transfer and condensation continued until the liquid iso-butanol had entirely evaporated from within the pressure chamber 15 as evidenced by stoppage of liquid iso-butanol condensation inside the diffusion chamber 33, as observed through the side glass 59. Because the critical temperature and pressure of iso-butanol are 265° C. and 705.6 psia, respectively, the drying process of this Example was conducted under subcritical conditions of the pore liquid.

Thereafter, the process described in Example 1 was followed exactly in the same manner, and a dry crack-free monolithic gel 11 was obtained. The linear shrinkage of the dry gel during the drying operation was determined to be negligible, i.e., less than 1%.

This Example shows that results comparable to those of earlier Example 1 can be achieved using the drying solvent iso-butanol instead of ethanol.

EXAMPLE 4

A gel 11 was prepared, aged and solvent exchanged in exactly the same manner as in Example 1. The wet gel was immersed in fresh ethanol in the glass container 13. The glass container 13 was then placed inside the same pressure chamber 15 as was used in Example 1, and the temperature of the pressure chamber 15 was raised by the heater 55 from room temperature (25° C.) to 172° C. This caused the chamber's pressure to increase to 223.7 psia. When these pressure and temperature values were reached, the stop valves 45 and 49 were opened, to pressurize the condenser 31 and the diffusion chamber 33 to the same 189.7 psia value. The stop valves 45 and 47 then were again closed and the ball valve 29 was opened, to allow solvent vapor to be transferred from the pressure chamber to the diffusion chamber.

To accelerate the vapor transfer to the diffusion chamber, the temperature of the pressure chamber was further raised from 172° C. to a final temperature of 232° C. This caused the pressure within the pressure chamber to increase correspondingly, until it reached a maximum pressure of 465.7 psia at 232° C. The vapor transfer and condensation continued until the liquid ethanol had entirely evaporated from within the pressure chamber. This was evidenced by a stoppage of liquid ethanol condensation inside the diffusion chamber 33, as observed through the side glass 59. The critical temperature and pressure for the pore liquid, ethanol, are 243° C. and 928 psia, respectively, so the process of this Example was carried out under subcritical conditions.

After, the remainder of the process described in Example 1 was followed exactly in the same manner, a dry crack-free monolithic gel was obtained. The linear shrinkage of the dry gel during the drying operation was determined to be negligible, i.e., less than 1%.

EXAMPLE 5

A gel 11 was prepared and aged in exactly the same manner as in Example 4, above, except that the pore liquid in the gel was exchanged with iso-propanol, rather than ethanol, and the gel was submerged in fresh iso-propanol in the glass cylinder 13 and then transferred to the same pressure chamber 15 as was used in Example 1.

Thereafter, the process described in Example 4 was followed exactly in the same manner, except that the temperature of the pressure chamber 15 was raised by the heater 55 from room temperature (25° C.) to 168° C., not 172° C. This caused the chamber's pressure to increase to 189.7 psia. When these pressure and temperature values were reached, the stop valves 45 and 49 were opened, to pressurize the condenser 31 and the diffusion chamber 33 to the same 189.7 psia value. The stop valves 45 and 47 then were again closed and the ball valve 29 was opened, to allow solvent vapor to be transferred from the pressure chamber to the diffusion chamber.

To accelerate the vapor transfer to the diffusion chamber, the heating of the pressure chamber 15 was continued, to raise its temperature from 168° C. to a final value of 226° C. The pressure within the pressure chamber continued to rise as the temperature rose, until it reached a maximum value of 328.7 psia, at 226° C. The vapor transfer and condensation continued until the liquid iso-propanol had entirely evaporated from within the pressure chamber. This was evidenced by stoppage of liquid i-propanol condensation inside the diffusion chamber 33, as observed through the side glass 59. Because the critical temperature and pressure of iso-propanol are 235.16° C. and 691.2 psia, respectively, the drying process of this Example was conducted under subcritical conditions of the pore liquid.

After the remainder of the process described in Example 4 was followed, exactly in the same manner, a dry crack-free monolithic gel was obtained. The linear shrinkage of the dry gel during the drying operation was determined to be negligible, i.e., less than 1%.

This Example shows that results comparable to those of earlier Example 4 can be achieved using the drying solvent iso-propanol instead of ethanol.

EXAMPLE 6

A gel 11 was prepared and aged in exactly the same manner as in Example 4, above, except that the pore liquid in the gel was exchanged with iso-butanol, rather than ethanol, and the gel was submerged in fresh iso-butanol in the glass cylinder 13 and then transferred to the same pressure chamber 15 as was used in Example 4.

Thereafter, the process described in Example 4 was followed in exactly the same manner, except that the temperature of the pressure chamber 15 was raised by the heater 55 from room temperature (25° C.) to 139° C., not 172° C. This caused the chamber's pressure to increase to 69.7 psia. When these pressure and temperature values were reached, the stop valves 45 and 49 were opened, to pressurize the condenser 31 and the diffusion chamber 33 to the same 69.7 psia value. The stop valves 45 and 47 then were again closed and the ball valve 29 was opened, to allow solvent vapor to be transferred from the pressure chamber to the diffusion chamber.

To accelerate the vapor transfer to the diffusion chamber, the heating of the pressure chamber 15 was continued, to raise its temperature from 139° C. to a final value of 242° C. The pressure within the pressure chamber continued to rise as the temperature rose, until it reached a maximum value of 160 psia, at 242° C. The vapor transfer and condensation continued until the liquid iso-butanol had entirely evaporated from within the pressure chamber. This was evidenced by a stoppage of liquid iso-butanol condensation inside the diffusion chamber 33, as observed through the side glass. Because the critical temperature and pressure of iso-butanol are 265° C. and 705.6 psia, respectively, the drying process of this Example was conducted under subcritical conditions of the pore liquid.

After the remainder of the process described in Example 4 was followed, exactly in the same manner, a dry crack-free monolithic gel was obtained. The linear shrinkage of the dry gel during the drying operation was determined to be negligible, i.e., less than 1%.

This Example shows that results comparable to those of earlier Example 4 can be achieved using the drying solvent iso-butanol instead of ethanol.

EXAMPLE 7

A wet gel 11 was produced using the same steps of gel preparation, aging, and solvent exchange as were conducted in Example 6, above. The wet gel also was loaded into the same pressure chamber, except that in this Example, the ball valve 29 was held open throughout the process. The pressure chamber was heated by the heater 55 from 25° C. to 220° C. The final pressure within the pressure chamber and the diffusion chamber 33 was 116.7 psia, at 220° C.

Because the critical temperature and pressure of iso-butanol are 265° C. and 705.6 psia, respectively, the drying process of this Example was conducted under subcritical conditions of the pore liquid.

After these maximum temperature and pressure values were reached, the process described in Example 6 was followed exactly in the same manner, and a dry crack-free monolithic gel 11 was obtained. The linear shrinkage of the dry gel during the drying operation was determined to be negligible, i.e., less than 1%.

EXAMPLE 8

A wet gel 11 was produced using the same processing steps of gel preparation, aging, and solvent exchange as were conducted in exactly the same manner as described in Example 3, above. The wet gel then was transferred to a glass cylinder 13 and submerged in fresh iso-butanol.

The glass cylinder 13 containing the wet gel 11 then was placed inside the pressure chamber 15 and covered by the inverted glass cylinder 25, and the pressure chamber was sealed from the outside environment and the ball valve 29 and all of the stop valves 35, 42, 45, 47 and 49 were closed. The chamber's temperature then was raised by the heater 55 from 25° C. to 187° C., which increased the chamber pressure to 124.7 psia. When this pressure and temperature were reached, the stop valves 45 and 49 were opened, to pressurize the diffusion chamber 33 with gaseous nitrogen from the gas cylinder 43. After the diffusion chamber's pressure reached 124.7 psia, the ball valve 29 was opened. At this same time, the stop valve 35 and the metering valves 37*a* and 37*b* were opened. This resulted in constant flow of nitrogen at the exit end of the condenser 31. The flow rate of nitrogen was regulated by the metering valves 37*a* and 37*b* such that the pressure of the pressure chamber 15 remained substantially constant at 124.7 psia, while vapor transfer and condensation of iso-butanol in the diffusion chamber continued.

After the ball valve 29 was opened and the nitrogen gas flow at the exit of the condenser 31 was initiated, the temperature of the pressure chamber 15 was continued to be raised, from 187° C. to a final value of 237° C. The pressure within the pressure chamber remained constant at 124.7 psia during this temperature increase, because of the nitrogen gas purging. After the temperature of the pressure chamber reached 237° C., the nitrogen gas purging was stopped by closing the stop valves 45 and 49. The pressure chamber then was depressurized to ambient pressure (14.7 psia), by maintaining the stop valve 35 open and controlling the depressurization rate using the metering valves 37*a* and 37*b*. The pressure chamber's temperature was maintained at 237° C. during this depressurization.

The critical temperature and pressure of iso-butanol are 265° C. and 705.6 psia, respectively, so the drying step in this Example was conducted under subcritical conditions. After the pressure chamber 15 was purged with nitrogen gas, by opening the stop valves 45 and 47, the chamber was cooled to room temperature and opened to produce a dry, crack-free monolithic gel 11. The linear shrinkage of the gel during the drying operation was determined to be negligible, i.e., less than 1%.

This Example shows that results comparable to those of earlier Examples 1–6 can be achieved while operating at an even lower maximum pressure. This can lead to reduced capital and operating expenses. In addition, maximum pressure is independently controlled at a constant value during drying.

It should be appreciated from the foregoing description that the present invention provides an improved apparatus, and related method of operation, for rapidly drying large wet gel monoliths of glass and ceramic material under subcritical conditions. The apparatus and method can function to dry the gel monolith without any significant likelihood of the gel cracking. The apparatus incorporates a pressure chamber for carrying the wet gel to be dried, with no significant limitation on the size of the gel relative to the size of the chamber, and the apparatus is configured to dry the gel at an even lower subcritical pressure than previous apparatus of this kind, leading to increased safety and reduced operating expenses.

Although the invention has been described in detail with reference to the presently preferred embodiment, those skilled in the art will appreciate that various modifications can be made without departing from the invention. Accordingly, the invention is defined only with reference to the following claims.

We claim:

1. A method for drying a porous monolith having a matrix that carries a liquid in its pores, comprising:

immersing the monolith in a prescribed drying solvent within a pressure chamber;

heating the pressure chamber to a temperature below the critical temperature of the drying solvent, to vaporize the solvent in a predetermined manner, such vaporization elevating the pressure within the chamber to a pressure still below the solvent's critical pressure;

maintaining the temperature and pressure within the pressure chamber at elevated values below the solvent's critical temperature and pressure, while drawing solvent vapor away from the pressure chamber, until the monolith is dry; and opening the pressure chamber and removing a dry monolith.

2. A method as defined in claim 1, wherein maintaining includes connecting the pressure chamber to a diffusion chamber having a temperature substantially colder than the pressure chamber, such that a significant portion of the solvent vapor is drawn to the diffusion chamber, where it is condensed.

3. A method as defined in claim 2, wherein the pressure chamber and the diffusion chamber, together, define a closed system.

4. A method as defined in claim 3, wherein the closed system further includes a condenser that condenses solvent vapor drawn away from the pressure chamber, for collection in the diffusion chamber.

5. A method as defined in claim 2, wherein:

the diffusion chamber is connected to a condenser that condenses solvent vapor drawn away from the pressure chamber, for collection in the diffusion chamber; and maintaining further includes pressurizing the condenser and diffusion chamber with an inert gas, at a selected, elevated pressure.

6. A method as defined in claim 1, wherein connecting the pressure chamber to the diffusion chamber occurs only after the temperature and pressure within the pressure chamber have reached predetermined values.

7. A method as defined in claim 6, wherein maintaining further includes continuing to heat the pressure chamber after the pressure chamber has been connected to the diffusion chamber, to accelerate the vaporization of the solvent located within the pressure chamber.

8. A method as defined in claim 1, wherein maintaining the temperature and pressure within the pressure chamber continues until solvent vapor ceases condensing within the diffusion chamber.

9. A method as defined in claim 1, and further comprising connecting the diffusion chamber to a continuous flow of an inert gas while solvent vapor is being drawn from the pressure chamber.

10. A method as defined in claim 9 wherein:

connecting the diffusion chamber to the continuous flow of an inert gas occurs substantially continuously while the solvent vapor is being drawn away from the pressure chamber; and the continuous flow of an inert gas has a substantially constant pressure.

11. A method as defined in claim 1, and further comprising directing an inert gas through the pressure chamber and to the condenser, after the monolith is dry, to condense additional solvent vapor.

12. A method as defined in claim 1, and further including depressurizing the pressure chamber to ambient pressure at a prescribed rate, after the monolith is dry.

13. A method as defined in claim 1, wherein maintaining includes continuing to heat the pressure chamber, to accelerate the vaporization of the solvent located within the pressure chamber.

14. A method as defined in claim 1, wherein heating and maintaining occur in such a manner that the temperature and pressure within the pressure chamber are independently controlled.

15. A method as defined in claim 1, and further comprising purging the pressure chamber with an inert gas after the monolith is dry.

16. A method as defined in claim 15, wherein:

the monolith is a silica gel;

the drying solvent is selected from the group consisting of ethanol, iso-propanol, iso-butanol, 2-pentanol, and 2,2,4-trimethylpentane, water, and mixtures thereof, and it is substantially the same as the liquid in the pores of the silica gel monolith; and the inert gas consists essentially of nitrogen.

17. A method as defined in claim 15, wherein:

the monolith is a silica gel;

the drying solvent is selected from the group consisting of ethanol, iso-propanol and iso-butanol; and the inert gas consists essentially of nitrogen.

18. A method as defined in claim 1, wherein heating and maintaining are effective in drying the monolith without cracking.

* * * * *